United States Patent [19]

Ferguson

[11] 4,381,914

[45] May 3, 1983

[54] CANDLEWICK

[76] Inventor: Glen E. Ferguson, 2987 E. Austin Way, Fresno, Calif. 93726

[21] Appl. No.: 193,252

[22] Filed: Oct. 1, 1980

[51] Int. Cl.[3] ..... F23Q 1/00

[52] U.S. Cl. ..... 431/267; 431/289

[58] Field of Search ..... 431/288, 289, 144, 278, 431/267, 269

[56] References Cited

U.S. PATENT DOCUMENTS 276,602 5/1883 Kirk ..... 431/289

FOREIGN PATENT DOCUMENTS 112694 12/1899 Fed. Rep. of Germany ..... 431/289

291 of 1868 United Kingdom ..... 431/288

7671 of 1898 United Kingdom ..... 431/288

*Primary Examiner*—Carroll B. Dority, Jr.

*Attorney, Agent, or Firm*—Vergil L. Gerard

[57] ABSTRACT

Disclosed is a candlewick in which the wick material is mounted adjacent a match with its head next to the wick tip, so that the tip is lighted when the match is struck. The wick base which has a neck and flange that isolate the bottom end of the wick material from the candle wax and snuff out the flame. The base is positioned far enough about the bottom of the candle to snuff out the flame before it causes any heat damage to the candle holder or supporting surface.

10 Claims, 3 Drawing Figures

CANDLEWICK

BACKGROUND OF INVENTION

This invention relates generally to candles and more particularly to candles with built in igniting and snuffing means.

Candles have been developed which incorporate a match in association with the wick material so that the wick tip may be ignited by striking the match. Candles have also been suggested that have means incorporated into the bottom of the wick to snuff the flame before it reaches the bottom of the candle. However, no one prior to my invention has successfully combined these features. Such a combination requires snuffing means that retain the match adjacent the wick material even after the wick is ignited and the match is burned out, and adequately isolate the wax from the wick so that snuffing is not prevented by the burned match bowing over into close proximity with the wax at the base of the candle.

OBJECTS AND ADVANTAGES

It is, therefore, a major object of my invention to provide an improved candlewick which successfully combines self igniting means and self snuffing means.

It is also an important object of my invention to provide an improved candlewick with self snuffing means which are not bridged and rendered ineffective by the self igniting means.

It is another object of my invention to provide an improved candlewick of the type described which can be inexpensively manufactured and is substantially trouble free.

These and other objects and advantages of my invention will become more readily apparent from the following detailed description and the associated drawings in which.

DETAILED DESCRIPTION OF THE PARTS

Figure 1:
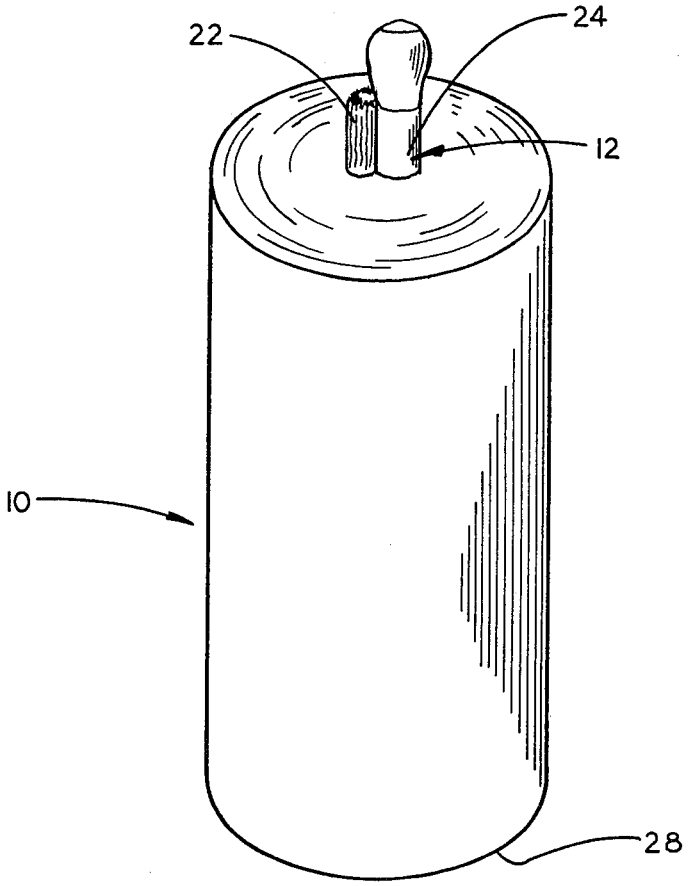
FIG. 1 shows a perspective view of a preferred embodiment of my invention.
Figure 2:
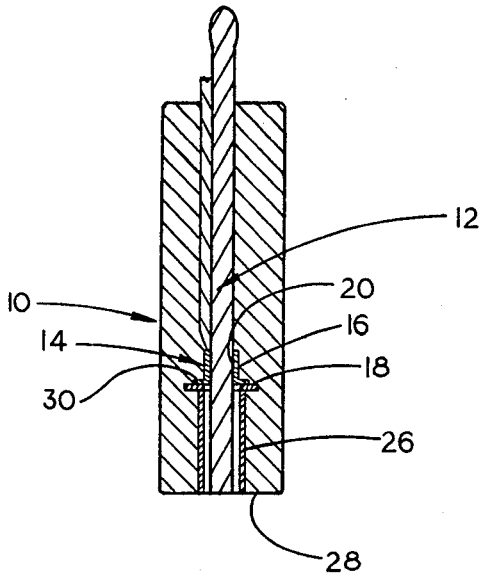
FIG. 2 is a cross-sectional view of the preferred embodiment.
Figure 3:
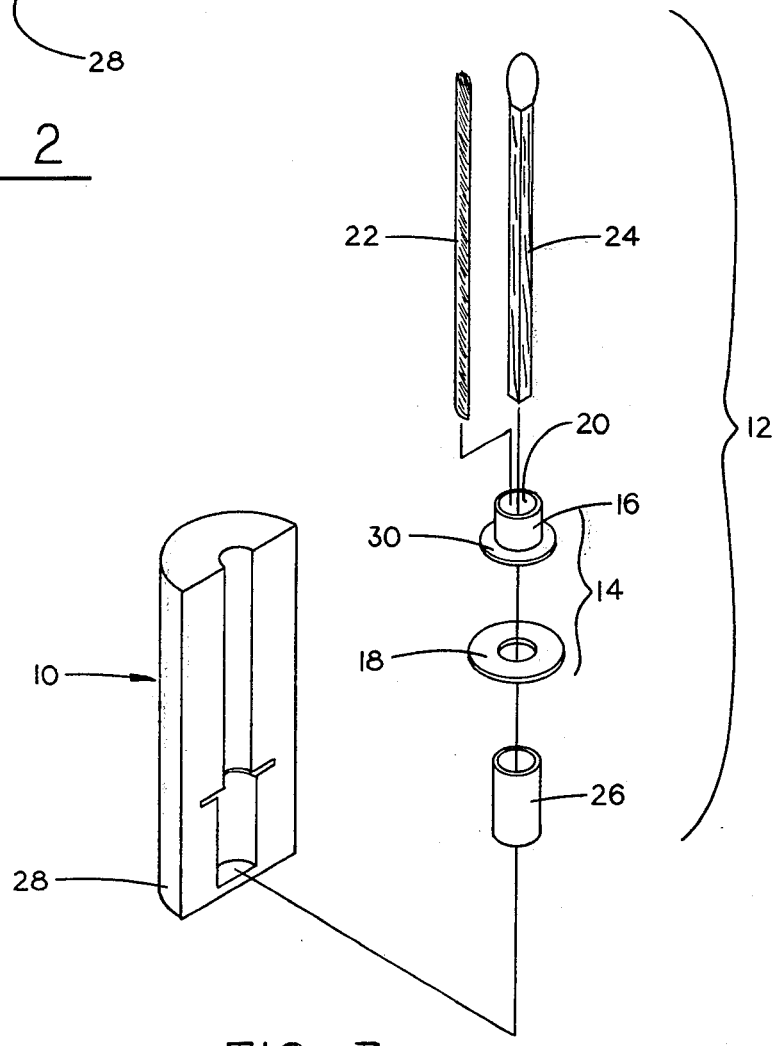
FIG. 3 is an exploded perspective view of my invention showing the interrelationship of the parts.

Referring now to the drawings, the numeral 10 designates a candle into which my improved candlewick 12 has been incorporated. My improved candlewick 12 has a base 14 with a neck 16 and flange 18. The neck 16 has a throat opening 20 into which the bottom end of a wick 22 and wooden match 24 are inserted for mounting. A spacer 26 is provided to position the flange 18 a desired distance above the bottom 28 of the candle. The spacer 26 is formed of heat insulating material so that heat is not carried from the base 14 to the candle bottom 28.

The neck 16 in my preferred embodiment is a standard eyelet with a rim 30 about its lower portion which upon assembly rests on the upper side of the flange (or washer) 18. In mass production it may prove preferable to unify these parts into a single base, but either form will work satisfactorily. The rim 30 alone does not extend radially outward far enough, however, to work well under certain circumstances, later described, so that a flange at least as large as flange 18 should be associated with neck 16.

When the wick 22 and match 24 are mounted in the neck 16, the head of the match will be adjacent the tip of the wick. Thus assembled my improved candlewick 12 is incorporated into candlewax to form the candle 10.

OPERATION

The operation of my improved candlewick 12 in the candle 10 is as follows. To ignite the tip of the wick 22, the user merely strikes the head of the match 24. After the wick is burning the candlewick 12 operated the same as other commonly known candlewicks except that the match 24 also burns with the wick and to some extent absorbs melting candlewax.

When the wick 22 has burned down to the base 14 the flame is snuffed as follows. The flame heats the neck 16 as it reaches the throat opening 20. The neck 16 is made of metal or other heat conducting material. The transfer of heat through the neck 16 melts the wax around the neck. When the wax surrounding the neck has receded sufficiently to isolate it from the wick, no more fuel is available to sustain the flame. Also, the oxygen supply becomes limited as the wick burns down inside the throat opening 20.

The flange 18 is also formed of metal or some other heat conducting material so the wax on top of the flame melts until substantially all of the wax available for sustaining combustion is below the flange.

Sometimes the remaining portion of the match 24 will curl so that its upper end bows downward toward the remaining bottom of the candle. Without the flange 18 the match may contact the wax and absorb and draw enough melted wax to sustain the flame. Flange 18 must, therefore, be large enough in diameter to prevent this from happening. Experimentation has proven that good results can be assured even though the diameter of flange 18 is not as large as the candle, and such a design is normally more desirable from an appearance standpoint. Nevertheless, the flange 18 can be made with a diameter equal, or greater, than that of the candle if that becomes desirable to assure that any bridging from the wick 22 in throat opening 20 and the remaining candlewax.

Once the supply of melted wax is denied to the wick and the oxygen is limited by entry of the flame into the throat opening 20, the flame is extinguished. Since the spacer 26 is a heat insulator it maintains the base 14 a sufficient above the candle holder or supporting surface to prevent damage to them from the flame heat, and the spacer resists transmission of the heat from the base 14 to the bottom of the candle.

From this detailed description of the parts of my improved candlewick and the manner of its operation, it should be understood that I have successfully combined into one candle self igniting means and self snuffing means. Moreover, my candlewick structure aides the mounting of the wick and match into the candle and is inexpensive to make.

It should also be understood that my improved candlewick is fully capable of achieving the objects and providing the advantages heretofore attributed to it.

I claim:

1. An improved candlewick comprising:

elongated wick means having a tip and a tail interconnected by a body portion;

ignitor means having a combustible shank with a head ignitable by frictional contact on one end and a stump on the other end, said ignitor means being juxtaposed said wick means with said shank paralleling said wick body portion and said heat adjacent said wick tip;

a base means having a neck and a flange, said neck having a recess having a longitudinal axis and being disposed to receive said tail of said wick means and said shank of said ignitor means and retain the same in close proximity and in general alignment with said longitudinal axis, and said flange being disposed to extend radially outward from said neck normal to the longitudinal axis of said recess; and spacer means disposed in supporting relationship with said base means, said spacer means being of heat insulating material and having height sufficient to elevate said base means above a candleholder or supporting surface a distance adequate to prevent heat damage thereto from the burning of said wick means.

2. An improved candlewick as described in claim 1 in which:

said base means flange extends radially outward from said longitudinal axis of said recess and substantially normal thereto.

3. An improved candlewick as described in claim 1 in which:

said base means is formed of heat conducting material.

4. In a candle, an improved candlewick comprising:

a string of wick materials mounted in said candle and having a tip extending upwardly from the top of said candle;

a match having a head ignitable by contact with a friction provoking surface, said match being juxtaposed said wick with its head adjacent said wick tip;

a base having a bore with its longitudinal axis aligned with the longitudinal axis of said candle, said bore being disposed to receive and mount the lower ends of said wick and match therein;

a flange operatively associated with said base and disposed to extend radially outwardly in said candle substantially normal to the longitudinal axis thereof a distance at lease equal to half the radius of said candle; and an elongated spacer disposed in said candle below said base and flange in supporting relationship thereto, said spacer having a height sufficient to prevent heat from a flame on said wick from damaging a surface supporting said candle.

5. In a candle, an improved candlewick as described in claim 4 in which:

said flange and base are formed of heat conducting material.

6. In a candle, an improved candlewick as described in claim 5 in which:

said flange extends radially outwardly for substantially the entire radius of said candle.

7. In a candle, an improved candlewick as described in claim 4, in which: said bore in said base has a height sufficient to separate said wick from the wax of said candle when said wick burns down to its bottom end and thereby snuff said wick.

8. An improved candlewick comprising:

ignitor means having a combustible shank with a head ignitable by frictional contact on one end and a stump on the other end, said ignitor means being juxtaposed said wick means with said shank paralleling said wick body portion and said head adjacent said wick tip;

a base having a neck and a flange, said neck having a recess having a longitudinal axis and being disposed to receive said tail of said wick means and said shank of said ignitor means; and spacer means disposed in supporting relationship with said wick tail and ignitor means stump, said spacer means being of heat insulating material and having a height sufficient to elevate said wick tail and ignitor means stump above a supporting surface a distance adequate to prevent heat damage thereto from the burning of said wick means and ignitor means.

9. An improved candlewick as described in claim 8, in which:

said wick means includes a string of wick material mounted in a candle and a tip extending upwardly from the top of said candle.

10. An improved candlewick as described in claim 8, in which:

said ignitor means includes a match having a head ignitiable by frictional contact on one end and a stump on the other end, said match being juxtaposed said wick means with said shank paralleling said wick body portion and said head adjacent said wick tip.

* * * * *